United States Patent [19]

Kress

[11] 4,429,524

[45] Feb. 7, 1984

[54] FALSE-TWIST DEVICE

[75] Inventor: Manfred Kress, Sömmersdorf, Fed. Rep. of Germany

[73] Assignee: FAG Kugelfischer Georg Schäfer & Co., Schweinfurt, Fed. Rep. of Germany

[21] Appl. No.: 360,912

[22] Filed: Mar. 23, 1982

[30] Foreign Application Priority Data

Mar. 28, 1981 [DE] Fed. Rep. of Germany ..... 3112426
Mar. 28, 1981 [DE] Fed. Rep. of Germany ..... 3148911

[51] Int. Cl.[3] ..... D02G 1/04
[52] U.S. Cl. ..... 57/336
[58] Field of Search ..... 57/334, 336

[56] References Cited

U.S. PATENT DOCUMENTS

| | | | |
|---|---|---|---|
| 2,262,589 | 11/1941 | Peck | 57/336 X |
| 3,045,416 | 7/1962 | Ubbelohde | 57/336 X |
| 3,813,867 | 6/1974 | Ivanto | 57/336 |
| 4,248,038 | 2/1981 | Takai | 57/336 |

FOREIGN PATENT DOCUMENTS

| | | | |
|---|---|---|---|
| 22552 | 7/1980 | European Pat. Off. | 57/336 |
| 2755808 | 6/1978 | Fed. Rep. of Germany | 57/336 |
| 2755809 | 6/1978 | Fed. Rep. of Germany | 57/336 |

*Primary Examiner*—Donald Watkins
*Attorney, Agent, or Firm*—Karl F. Ross; Herbert Dubno

[57] ABSTRACT

A false-twist device of the type in which a pair of crossing belts engage and twist the yarn between them utilizes magnetic means to press the belts together and apply a uniform force to the yarn.

11 Claims, 6 Drawing Figures

FALSE-TWIST DEVICE

FIELD OF THE INVENTION

My present invention relates to a device for imparting a false twist to a yarn and, more particularly, to a false-twist device of the type which utilizes a pair of crossing endless bands in contact with one another.

BACKGROUND OF THE INVENTION

While devices for imparting a false twist to a yarn abound in the art, a particular interest can be found in a false-twist device of the type described in German Pat. No. 2,628,396. In this false-twist device, a pair of endless belts or bands are oriented so that respective passes or stretches of the belt cross one another, preferably at right angles, the yarn being fed to the crossing point so as to include angles of 45° with both of the belts.

The two belts can lie in respective mutually intersecting planes and the yarn can pass perpendicularly through the line at which the planes intersect.

The belts may be driven at the same or different speeds and impart, as described in that publication, a false twist to the yarn.

One of the problems encountered with this system, however, is the need to provide means for pressing the yarn and contacting surfaces of the belts toward one another uniformly.

For this purpose, in practice, pressing plates or other members have been required.

However, in an operation of conventional false-twist devices of this type, vibrations in the yarn-contacting pass or stretch frequently cause the belts to slap together and hit the yarn in a fluctuating manner, to the detriment of uniform operation.

With the conventional systems, therefore, it was difficult, it not impossible, to ensure a constant pressure of the belts against the yarn.

OBJECTS OF THE INVENTION

It is the principal object of the present invention to provide an improved false-twist device, i.e. a device capable of imparting a false twist to a yarn, whereby the disadvantages of this earlier system are obviated.

Another object of this invention is to provide a crossing-belt false-twist device having uniform contact force against the yarn.

Still another object of this invention is to provide an improved method of operating a false-twist device so as to produce a more uniform product.

SUMMARY OF THE INVENTION

These objects and others are attained, in accordance with the present invention, in a false-twist device in which a pair of mutually crossing belts sandwich the yarn, which is fed generally transversely to both belts, between them. The belts are urged together at the crossing location by magnetic-field forces.

The magnetic forces drawing the belts together in the region of contact with the yarn can be generated by making at least one of the belts magnetic or magnetizable so that this belt can be attracted toward the other belt.

The interaction of the magnetic or magnetizable belt toward the other belt can be an interaction in the direction of a permanent magnet disposed on the other belt, formed by the other belt, or disposed behind this other belt in the direction of magnetic force application to the magnetically permeable belt.

In a preferred embodiment of the invention at least one of the belts is magnetically attracted while the other belt is magnetically attractable and the intrinsic magnetic forces between the belts generate the force with which the belts are urged toward one another and against the yarn.

It has been found to be advantageous to provide the magnetic force at least in part by means of a magnetic powder which is applied to a surface of at least one of the belts and which can be bonded to this belt, e.g. by vulcanization.

Preferably, at least the surfaces of the friction belts engaging the yarn are composed of rubber or other elastomer facilitating such vulcanization.

One or both of the friction belts can be provided with a magnetic foil which can be embedded therein, this foil being preferably perforated. It is also possible, in accordance with the invention, to reinforce one or both of the belts with stranded, woven, braided or fabric-like reinforcement of a magnetic material, e.g. a ferromagnetic substance to generate the magnetic force.

It is apparent that the system of the present invention generates, without contact with the belts (as is the case with prior art pressing means), magnetic forces which press one of the belts against the yarn and the other belt and vice versa so that the frictional action of the belts upon the yarn is effected with a constant magnetic force, since the magnetic force increases as a function of the square of the proximity between the magnetic bodies and the two belts. Drawn into close proximity to one another, they practically lie in contact except where they are held apart by the yarn in the crossing region to that a substantially contact force is generated.

Another advantage of this invention is that the intrinsically generated force at the crossing allows the tension on the belts to be reduced. In prior art systems, considerable tension had to be applied to minimize the slapping action. As a result, the lift of the belts is increased, complex and expensive belt-tightening devices are avoided, and any relief of the belt tension does not necessarily reflect adversely on the force applied between the belts.

I have found that it is possible to reinforce the intrinsic magnetic forces between the two belts by providing in the region of the crossing a permanent magnet. The magnet can be so poled that its contribution is either an attraction or a repulsion and such that it can add to or reduce the intrinsic magnetic force and thus vary the contact pressure with which the belts bear upon the yarn. This allows compensation for yarns of different materials or diameter.

It is possible to provide a permanent magnet which supplies a magnetic force to one of the belts, e.g. a belt provided with braided or woven ferromagnetic reinforcing wire such that this belt is pressed against the yarn and the other belt.

SPECIFIC DESCRIPTION

Figure 1:
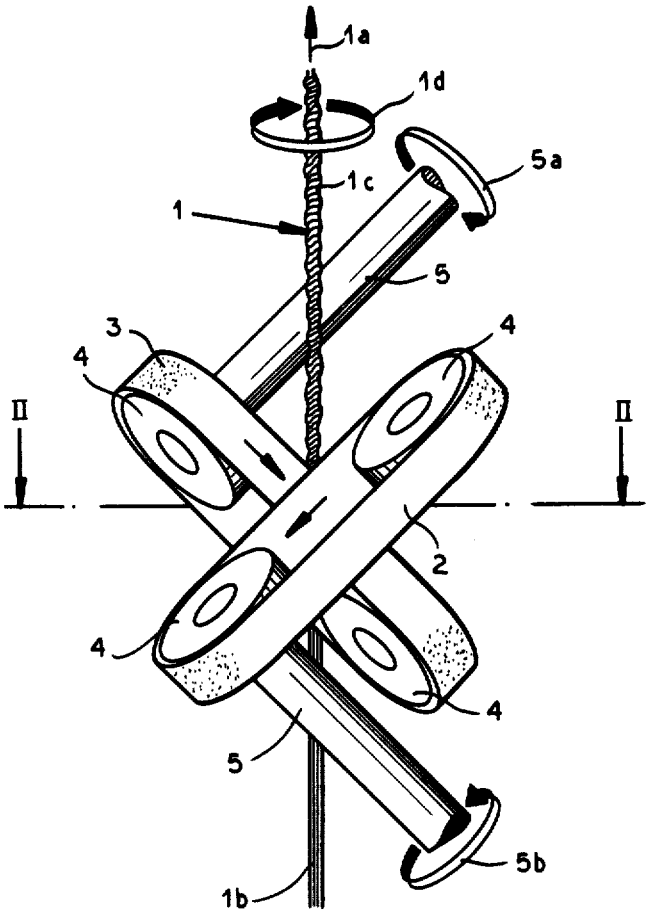
FIG. 1 is a somewhat diagrammatic perspective view of a false-twist device illustrating the principles of the present invention.

The false-twist device shown in FIG. 1 is, in principle, similar to the false-twist device of the above mentioned publication in that a pair of crossing belts 2, 3 sandwich the yarn 1 between them and impart the twist to this yarn by frictional engagement of the yarn by the moving belt surfaces.

For example, the friction belts 2 and 3, which can have yarn-engaging surfaces of rubber, are carried on rollers or pulleys 4, one of which can be driven as shown by the shaft 5 and the arrows 5*a* and 5*b*.

The yarn is fed between the belts in the direction of the arrow 1*a* and the portion 1*b* of the yarn 1 below the crossing region is shown to be free from the twist while the portion 1*c* above this region is shown to have a false twist in the sense represented by the arrow 1*d*.

The supports for the belt pulleys and the like are all conventional in the art and have not been illustrated. The drawing does, however, show that each belt lies in a plane, that the planes intersect the right angles, and that the yarn passes through the belts perpendicular to the line of intersection of these two planes.

Figure 2:
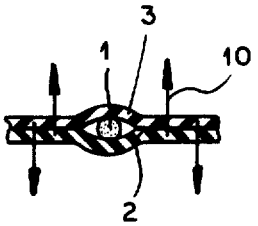
FIG. 2 is a section taken along lines II—II of FIG. 1.

The two belts are magnetic and magnetically attract one another. As a result, magnetic forces are generated in the direction of the arrows 10 as can be seen in FIG. 2. The magnetic force can be generated by incorporating permanently magnetized ferrite particles in one of the bands and ferromagnetic particles in the other band so that the first band attracts the other.

Alternatively, both bands can be provided with permanent magnet particles so oriented or poled so that the confronting sufaces of the bands have opposite polarities. In either case magnetic forces as represented by the arrows 10 will uniformly press the belts against one another and against the yarn.

Figure 3:
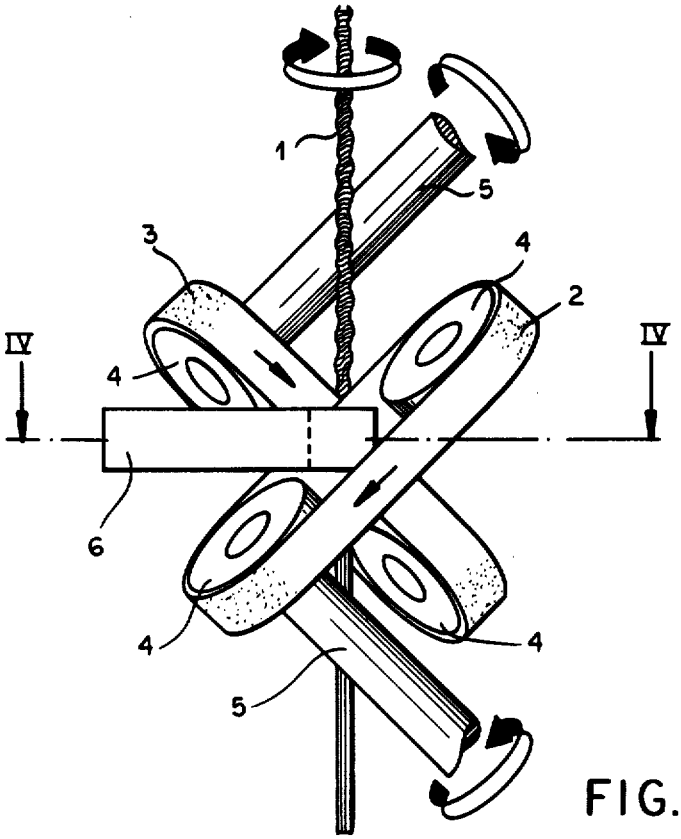
FIG. 3 is a view similar to FIG. 1 illustrating another embodiment of the invention in which a permanent magnet outside the belts is utilized to supply, control or augment the magnetic force.

The embodiment of FIG. 3 corresponds to that of FIG. 1 except that the force is generated, controlled or augmented with the aid of a permanent magnet system which does not, however, contact the belts.

Figure 4:
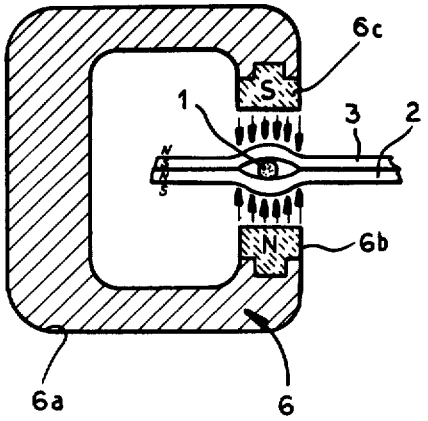
FIG. 4 is a section taken along the lines IV—IV of FIG. 3.

In this case, a permanent magnet 6 is provided across the false twist region as is best seen in FIG. 4.

In this case, a permanent magnet can comprise a ferromagnetic yoke 6*a* and pole pieces 6*b* and 6*c* having respective north and south poles turned toward one another so that corresponding polarities are included in the belts 2 and 3 which can be magnetic as previously described or simply formed by incorporating ferromagnetic wires as reinforcements in the belt. The belt 2, for example, will have a south pole turned toward the north pole of member 6*b* and hence the north pole turned toward the other belt whereas the belt 3 will have, by induction a north pole turned toward member 6*c* and a south pole turned toward the belt 2. Thus the magnetic forces induced in the belts cause attraction and provide the false-twist pressure.

Obviously, the electromagnet can also be used for this purpose and the pressure of the belts on the yarn can be varied by modifying the force generated by the electromagnet. Furthermore, if the belts are magnetic as described in connection with FIGS. 1 and 2, the externally applied magnetic field can be utilized to reinforce or reduce the interbelt magnetic field and hence vary the pressure.

Figure 2A:
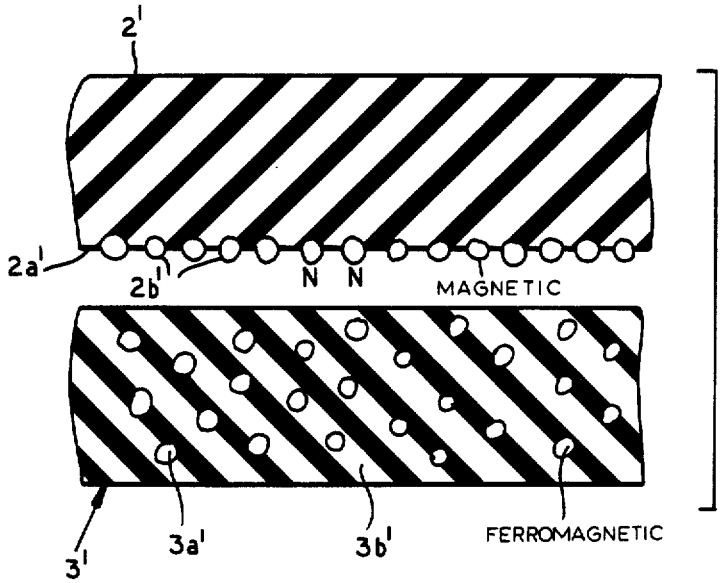
FIG. 2A is an enlarged diagrammatic section illustrating a pair of belts which can be used for this purpose.

In FIG. 2A I have shown a belt 2′ formed from an elastomeric material, e.g. rubber, having its yarn engaging surface 2*a*′ covered with magnetic particles 2*b*′ which are vulcanized in place and polarized so that, for example, north poles of the particles are turned toward the other belt 3′.

This belt can contain iron particles 3*a*′ dispersed therein and vulcanized in the elastomeric matrix 3*b*′ of the belt.

Figure 2B:
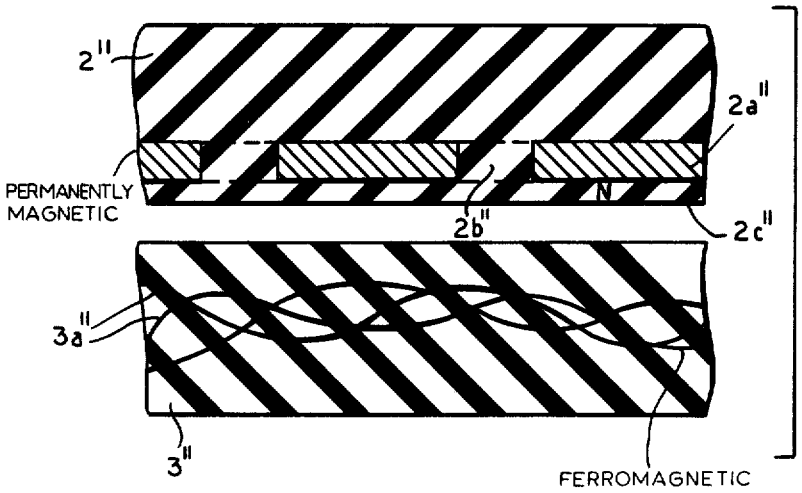
FIG. 2B is a view similar to FIG. 2 illustrating another embodiment.

In the embodiment of FIG. 2B one belt 2″ can be provided with a magnetic foil 2*a*″ formed with perforations 2*b*″ and polarized so that its north pole surface 2*c*″ is taken toward the other belt 3″ containing a braided reinforcement fabric 3*a*″ of ferromagnetic material.

I claim:

1. A method of imparting a false twist to a yarn, comprising the steps of:
   (a) passing said yarn between a pair of crossing driven belts; and
   (b) pressing said belts against said yarn and toward each other with magnetic force generated in the crossing region.

2. A device for imparting a false twist to a yarn, comprising:
   a pair of endless driven belts having crossing juxtaposed stretches with said yarn passing between said stretches at the crossing region; and
   magnetic means for pressing said stretches of said belts against said yarn and toward one another in said region.

3. The device defined in claim 2 wherein said magnetic means includes permanent magnet means in at least one of said belts applying an interactive force to the other of said belts.

4. The device defined in claim 3 wherein said other of said belts contains ferromagnetic material.

5. The device defined in claim 3 wherein the other of said belts contains permanent magnet material.

6. The device defined in claim 2 wherein said magnetic means includes a permanent magnet generating a magnetic field in said region and means in at least one of said belts responsive to said field for applying a force in the direction of the other of said belts.

7. The device defined in claim 3 wherein said magnetic means includes magnetic powder disposed along the surface of at least one of said belts.

8. The device defined in claim 7 wherein said magnetic powder is vulcanized to said one of said belts.

9. The device defined in claim 2 wherein said magnetic means includes a magnetic foil in at least one of said belts.

10. The device defined in claim 9 wherein said magnetic foil is perforated.

11. The device defined in claim 2 wherein at least one of said belts is provided with a braid of ferromagnetic wire.

* * * * *